US007165610B2

(12) United States Patent
Hopper

(10) Patent No.: US 7,165,610 B2
(45) Date of Patent: Jan. 23, 2007

(54) REMOVABLE SEAL

(75) Inventor: Hans P. Hopper, Whiterashes (GB)

(73) Assignee: Cameron International Corporation, Houston, TX (US)

( * ) Notice: Subject to any disclaimer, the term of this patent is extended or adjusted under 35 U.S.C. 154(b) by 218 days.

(21) Appl. No.: 10/936,284

(22) Filed: Sep. 8, 2004

(65) Prior Publication Data

US 2005/0061499 A1 Mar. 24, 2005

(30) Foreign Application Priority Data

Sep. 24, 2003 (EP) ..... 03256020

(51) Int. Cl.
*E21B 23/02* (2006.01)

(52) U.S. Cl. ..... 166/84.4; 166/84.1
(58) Field of Classification Search ..... 166/84.1–84.5
See application file for complete search history.

(56) References Cited

U.S. PATENT DOCUMENTS

| | | | | |
|---|---|---|---|---|
| 3,621,912 | A | 11/1971 | Wooddy, Jr. et al. | 166/0.5 |
| 5,279,365 | A * | 1/1994 | Yenulis et al. | 166/84.3 |
| 6,129,152 | A | 10/2000 | Hosie et al. | 166/384 |
| 6,325,159 | B1 | 12/2001 | Peterman et al. | |
| 6,554,016 | B1 * | 4/2003 | Kinder | 166/84.3 |
| 2001/0050185 | A1 | 12/2001 | Calder et al. | 175/5 |

* cited by examiner

*Primary Examiner*—David Bagnell
*Assistant Examiner*—Matthew J. Smith
(74) *Attorney, Agent, or Firm*—Conley Rose, P.C.

(57) ABSTRACT

A removable seal 10 is provided for positioning in a bore 14 around an element which, in use, passes therethrough. The seal comprises: a cylindrical outer sleeve 13 having an axial bore, the sleeve 13 having at least one engagement portion for engaging, in use, with an internal surface of the bore 14; and a sealing element 17 mounted on the cylindrical outer sleeve 13 for, in use, extending into the axial bore 14 to seal around the element passing therethrough.

18 Claims, 4 Drawing Sheets

REMOVABLE SEAL

BACKGROUND OF THE INVENTION

1. Field of the Invention

This invention relates to a removable seal and, in particular, to a removable seal which can be positioned in a bore and which can seal, around an element passing through the bore, which, in the preferred example, is a subsea bore such as a riser, BOP package, or well.

In conventional drilling, completion or workover modes, the well fluids are conditioned to allow equipment to access the well under atmospheric pressure. This is achieved by using fluids in the well that exert a over pressure on the open formation which prevents a well influx of fluid from the formation. This method can cause sever damage to the formation and hinder future production rates from a potential reservoir.

An alternative type of operation is to control the well bore pressure in a mechanical manner at a suitable point in the well system which allows the use of optimum types of mud or fluids.

When drilling and operating these wells, either surface or subsea, a two zone pressure regime has to be maintained between the well and the atmosphere. These two zone pressure regime must be maintained even while other downhole operations such as low pressure drilling, completing and testing of the well are carried out, for example, a tubular string passing through a BOP stack on top of the well head.

On a subsea well using a subsea BOP stack, a drilling riser connects the subsea system to the surface vessel. The riser could contain a hydrostatic head of fluid which could provide a undesired pressure effect on the downhole well operations. At different stages of the construction and operation of the well, whether mud, water, oil, foam or gas is being used, the system must be capable of operating with either a high pressure differential in the well relative to the riser or, vice versa, a high pressure in the riser relative to the well. Irrespective of the pressure in the riser, the desired pressure in the well must not be affected.

During the construction and operation of the surface or subsea well, it is often necessary to pass different elements through the various apparatus through the top of the wellhead, for example through the BOP stack, etc. and these elements can include, but are not limited to, drill pipe, tubing strings, casings, wire line, cables and the like. However, due to the movement of these devices, and associated tools and the like which may be mounted on these elements, typically on the lower end, prior known seals which have been utilised to seal the bore through which the elements pass have become damaged and, accordingly, loose their primary function which is to seal the bore around the element passing therethrough.

Typically, the seals which have been previously used are formed as part of the bore itself, for example, as part of a BOP stack or part of a riser section which requires disconnection of the packages to insert a replacement. Accordingly, it is difficult to rectify the damage to the seal, either by repair or replacement, without removing the particular section or apparatus from the well head or associated riser, thereby resulting in significant down time for the well. This results in the operator of the well suffering additional costs whilst the equipment lies idle whilst replacing or repairing a component.

As an example, to seal the BOP bore when drilling, a conventional annular seal is normally used and this allows stripping in and out in coordination with the other annulars.

However, as these annulars are part of the BOP package, wear and damaged would require the well to be killed, the damaged BOP package to be withdrawn and replaced by a repaired BOP package. This could typically take 3–6 days in deep water and such a delay is a major disadvantage to the operator of a well.

2. Description of Related Art

U.S. Pat. No. 3,621,912 to L. D. Wooddy, Jr. shows a remotely operated rotating wellhead having a sealing element made of resilient material and a bearing element.

A rotating blowout preventer is disclosed in U.S. Pat. No. 6,129,152 to D. G. Hosie et al. A flexible bladder that is directly activated by a radially disposed pressure chamber to allow for gas tight sealing of a drill pipe therein is shown.

U.S. Patent Application Publication No. US 2001/0050185 A1 to I. D. Calder et al. shows a rotating drilling head with hydraulically inflatable seal for sealing around drill pipe disposed in the drilling head.

SUMMARY OF THE INVENTION

According to the present invention, there is provided a removable seal for positioning in a bore around an element which, in use, passes therethrough, the seal comprising:

a cylindrical outer sleeve having an axial bore, the sleeve having at least one engagement portion for engaging, in use, with an internal surface of the bore; and a sealing element mounted in the cylindrical outer sleeve for, in use, extending into the axial bore to seal around the element passing therethrough.

Accordingly, the present invention provides a seal which can easily be run into the bore of a housing body using drill pipe, or on a bottom hole assembly or the like, and located in the appropriate position in the bore. Should the seal become damaged, it is an easy process to withdraw the removable seal as it can be disengaged from the internal surface of the bore, picked up by drill pipe or other such device and replaced.

Preferably, the sealing element is rotatably mounted in the outer sleeve to ensure that when sealing around a rotating pipe, the seal element is not damaged by friction between the sealing element and the string. Further, the outer sleeve preferably includes an annular recess on the inner wall of the sleeve in which the sealing element is retained. The sealing element may be mounted on a rotatable inner sleeve within the annular recess. Alternatively, the sealing element may be rotatably mounted adjacent either end of the outer sleeve. A further sealing element is preferably provided between the rotatable inner sleeve and the outer sleeve to prevent fluid flow therebetween.

The removable seal preferably further comprises one or more biassing elements for urging the sealing element to its retracted position. Preferably, the biassing means is at least one retracting spring ring retained within the sealing element.

The present invention further provides a sealing mechanism for use in a bore, the mechanism comprising;

a body having a bore extending therethrough;

an engagement means for extending from a wall of the body into the bore for engagement with a removable seal according to any one of the preceding claims;

at least one seal for preventing the fluid flow between the removable seal and the inner wall of the body; and actuating means for causing, in use, the sealing element to extend into the axial bore within the outer sleeve of the removable seal.

In a preferred embodiment, the sealing element is expandable, preferably under hydraulic pressure, into the axial bore of the cylindrical outer sleeve.

At least one seal for preventing fluid flow between the removable seal and the inner wall of the body may be retractably mounted within the body. The retractable seal preferably engages with a recess on the outer sleeve of the removable seal and locates the removable seal in place.

The mechanism may further comprise a retractable orientation pin, mounted within the body, for engagement with an orientation profile on the outer sleeve of the removable seal to ensure that the seal is correctly oriented in the bore to provide a final landing shoulder. When the orientation pin is retracted, this configuration allows full through bore access for well operations or to pass a lower removable seal through the body.

The mechanism preferably further comprises a supply of a controlled hydraulic fluid within the body such that the actuating means supplies hydraulic fluid to cause the sealing element to extend into the bore.

Preferably, the mechanism further comprises a hydraulic fluid system for operating the retractable seal and/or the orientation pin.

It is, of course, possible to use more than one removable seal in series in a bore and the second or subsequent seal may engage with the same body as the first seal or, alternatively, may be connected to a separate body within the bore. By using two removable seals, one can be replaced if necessary without comprising the ability to seal the bore and isolate the well whilst this replacement is carried out.

A principal object of the present invention is to provide a removable seal which overcomes the disadvantages identified above.

These with other objects and advantages of the present invention are pointed out with specificness in the claims annexed hereto and form a part of this disclosure. A full and complete understanding of the invention may be had by reference to the accompanying drawings and description of the preferred embodiments.

BRIEF DESCRIPTION OF THE DRAWINGS

These and other objects and advantages of the present invention are set forth below and further made clear by reference to the drawings, wherein.

DESCRIPTION OF THE PREFERRED EMBODIMENTS

Figure 1:
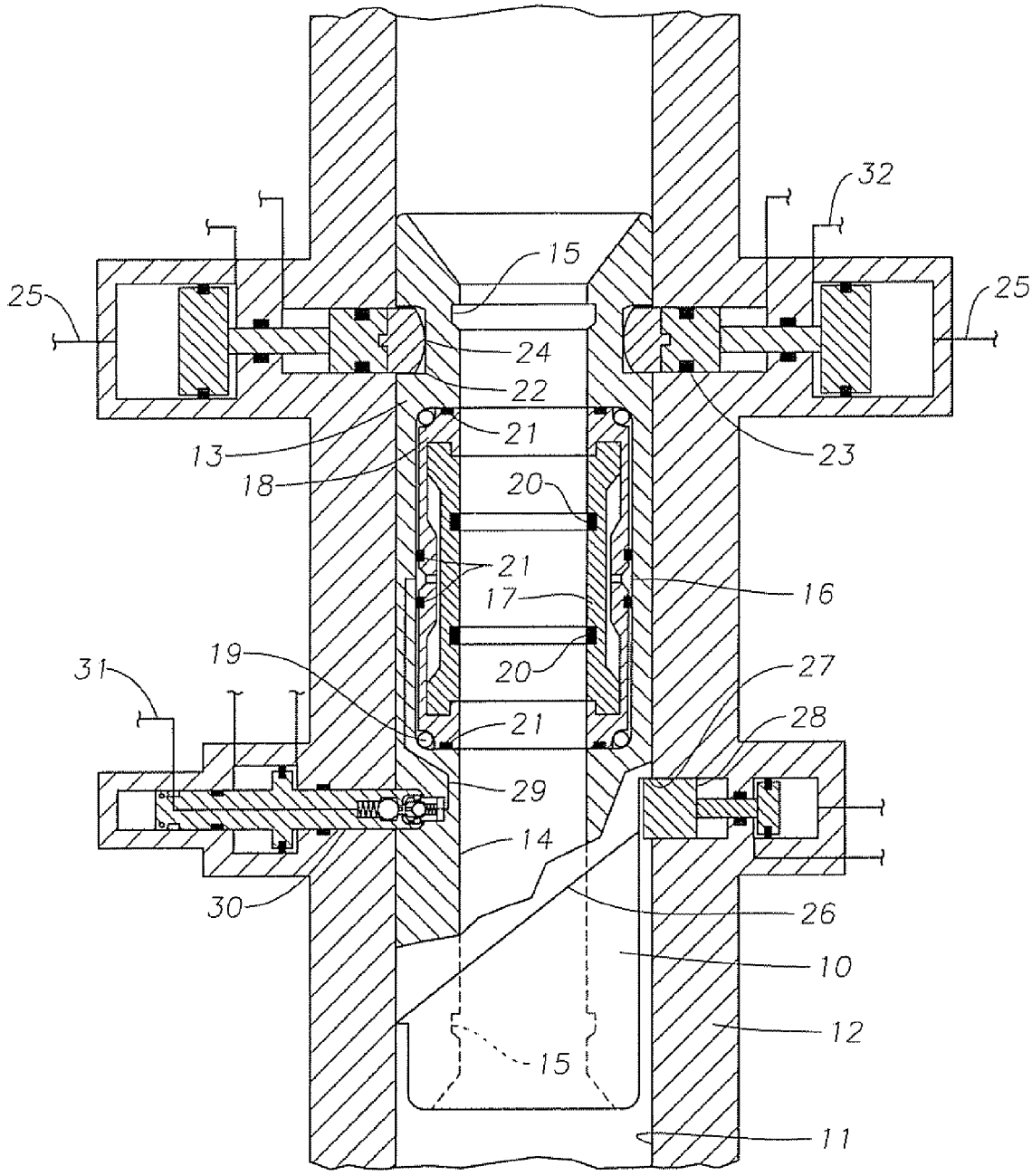
FIG. 1 shows a schematic longitudinal cross sectional view through one example.

FIG. 1 shows a removable seal 10 located within a bore 11 in a housing body 12. The removable seal comprises a cylindrical outer sleeve 13 through which an axial bore 14 is provided. The bore 14 is flared at each end. In this example, the bore 14 is provided with a recess portion 15 at each of the upper and lower ends. The recess portion and the flared shape enable the seal 10 to be engaged with a drill string, bottom hole assembly or other components on which the removable seal 10 can be run into the bore 11.

The outer sleeve 13 is provided with a main recess portion 16 in which a sealing element 17 is mounted on a rotatable inner sleeve 18. The inner sleeve 18 is mounted on bearings 19 to enable it to rotate within the recess 16. In this example, the sealing element 17 is provided with retracting spring rings 20 which bias the sealing element 17 to the retracted position shown in FIG. 1. Various seals 21 are provided between the inner sleeve 18 and the wall of the recess 16 to prevent control fluid flowing therebetween.

The outer sleeve 13 is provided, towards its upper end, with recess portions 22 in its outer wall. The recess portions are for receiving a bi-directional sealing lock ram 23, extendable from the wall of the housing body 12 to lock the removable seal 10 in the bore 11. The lock rams 23 include a seal 24 which prevents any fluid flow past the removable seal 10 between the outer sleeve 13 and the wall of the housing body 12. Typically, the lock rams 23 are operated by hydraulic actuation via fluid supply lines 25 and 32.

The recess portion 22 is shaped to provide an inner protected seal surface for seal lock ram 23 to compress against to provide a seal and to also provide shoulders against the ram 23 to prevent the removable seal 10 moving up or down if forces are applied from above or below.

Towards its lower end, the outer sleeve 13 has an orientation helix 26 which is shaped so as to provide, at its upper end, a locating shoulder 27 which, when the removable seal 10 is run into the bore 11, engages with an orientation pin 28, which can be moved out of the wall of the housing body 12 to provide the appropriate location and orientation for the removable seal 10. After the removable seal 10 has been correctly located, the bi-directional sealing lock rams 23 can be actuated to lock and seal the removable seal 10 in the bore 11. Only after these steps have been confirmed is the hydraulic control pin 30 actuated.

The seal 17 is caused to extend into the axial bore 14 by supplying hydraulic fluid into the rotatable inner sleeve 18. The hydraulic fluid is supplied via pathway 29 which connects with a hydraulic control pin 30 which can, in use, be extended out of the housing body 12. When the hydraulic control pin 30 is actuated, hydraulic control fluid is supplied via line 31 at a controlled pressure, thereby causing the sealing element 17 to extend to the axial bore 14. When the seal is to be retracted, a preferred option is to provide a negative pressure differential between the hydraulic fluid vent pressure to the pressure of the fluid in the bore. Alternatively, and not shown in the figures, the sealing element 17 may be cause to extend into the axial bore 14 under compression which distorts the shape of the sealing element 17.

Figure 2B:
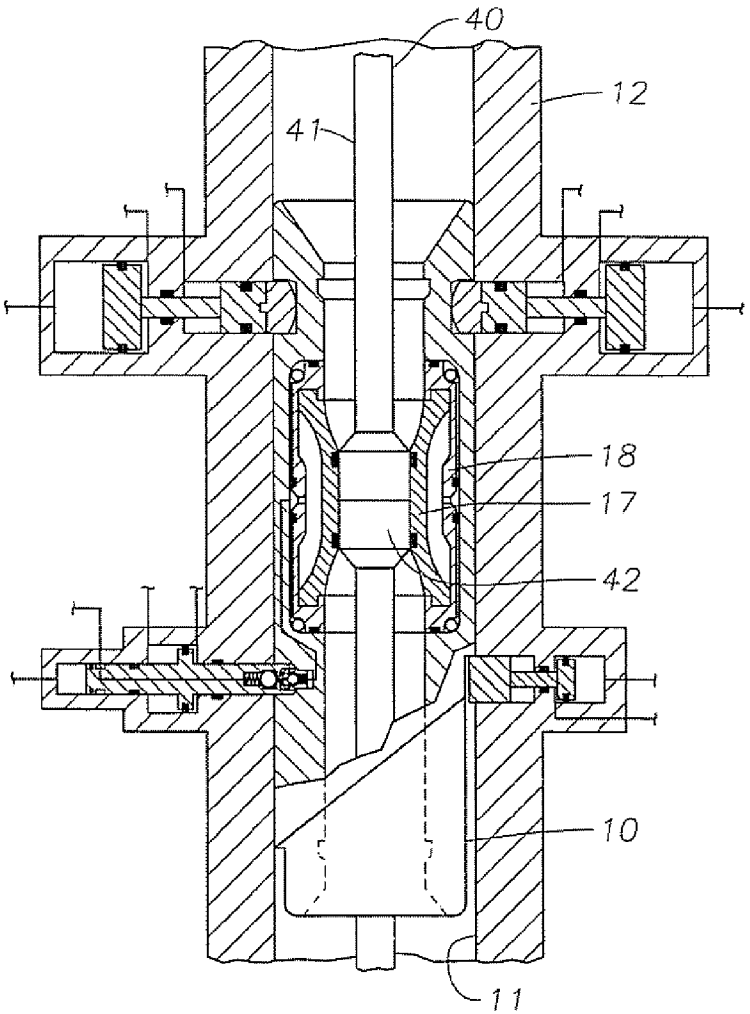
FIGS. 2*a* and 2*b* show partial longitudinal cross sectional views through the example of FIG. 1 in use.
Figure 2A:
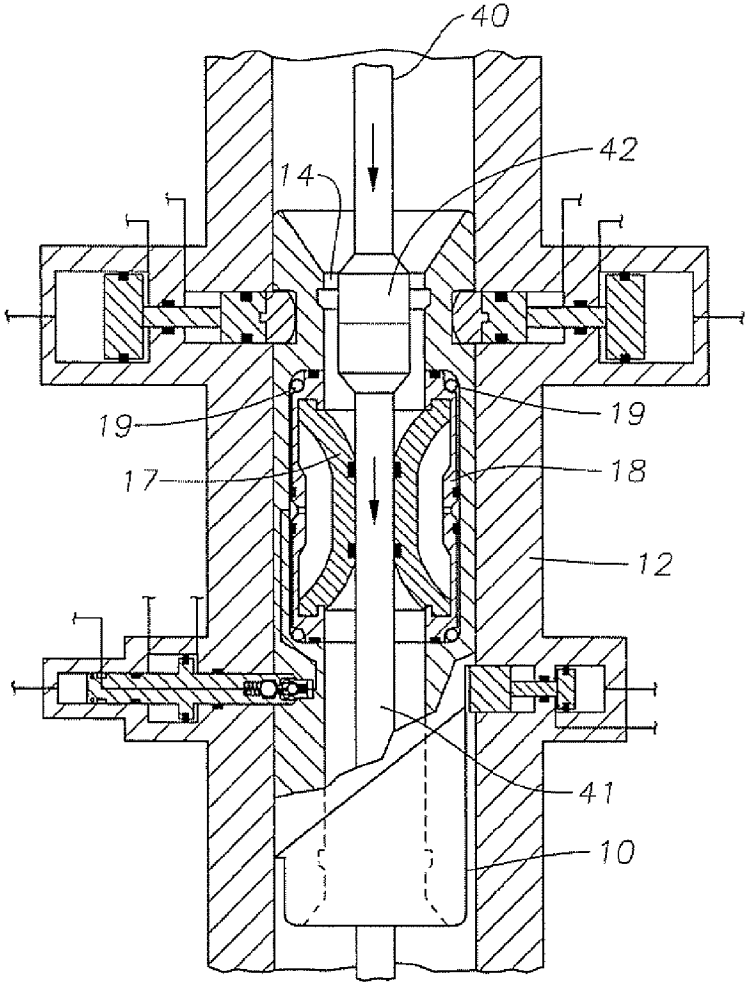

FIG. 2*a* and 2*b* illustrate the removable seal 10 in operation as a tubular pipe 40 is passed through the axial bore 14. In FIG. 2*a*, the sealing element 17 is extended into the axial bore 14 to seal around the narrower diameter portion 41 the tubular pipe 40. In the event that the tubular pipe is caused to rotate, the sealing element 17 will rotate with it, as the inner sleeve 18 is mounted on bearings 19 and, accordingly, wear to the sealing element 17 will be minimised. As the tubular pipe 40 is lowered through the removable seal 10, the tool joint or connection 42, which typically has an increase diameter when compared to the remainder of the tubular pipe 40, is caused to pass through the sealing element 17 which is forced back towards the inner sleeve 18 to allow the tool joint 42 to pass. It may be necessary to adjust the pressure of the hydraulic fluid supplied to the sealing element 17 in order to allow the tool joint to pass directly or by using an accumulator that allows the control volume in the sealing element 17 to change at a nearly constant pressure. This means the seal around the tubular pipe 40 is maintained.

Figure 3:
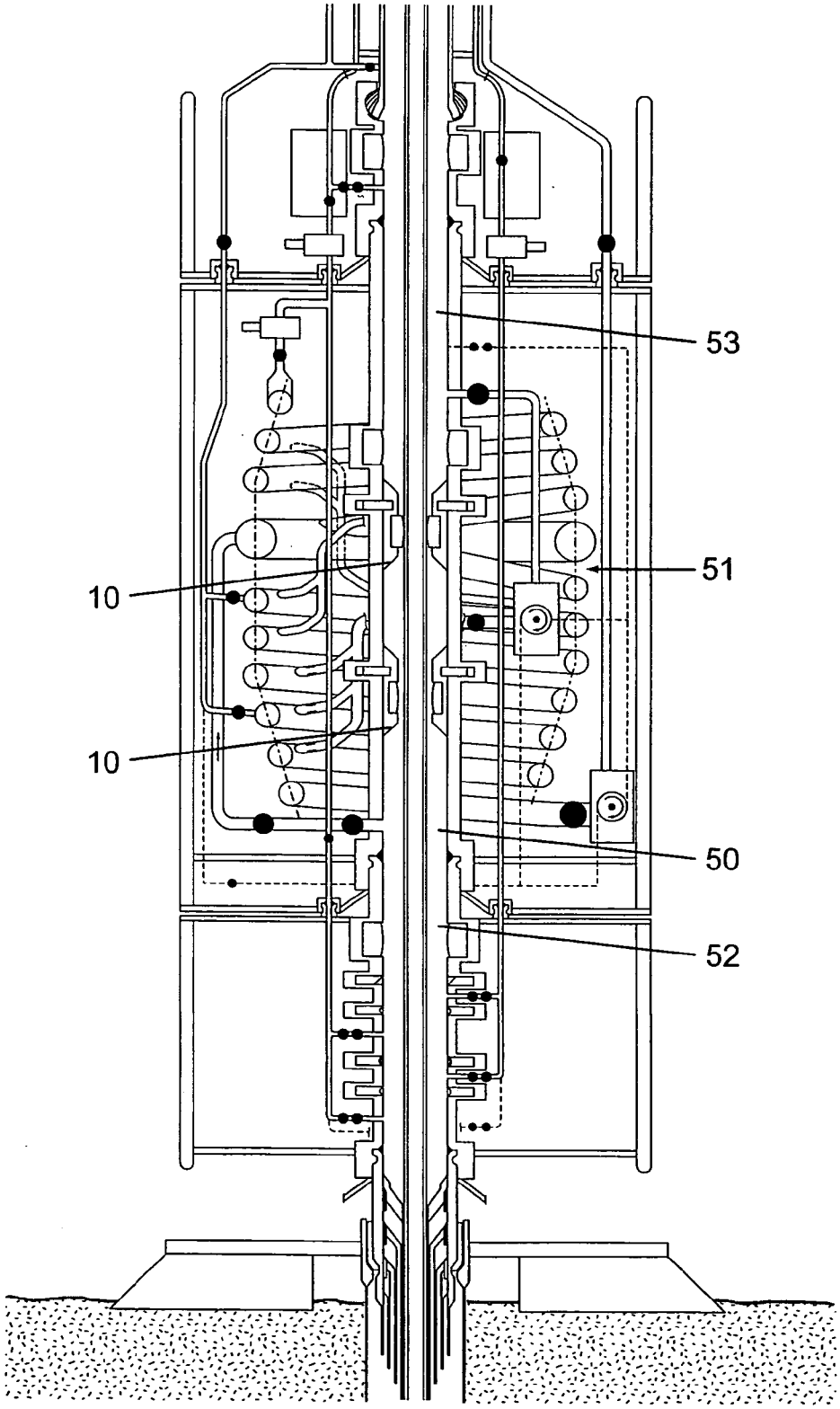
FIG. 3 shows a possible arrangement of a subsea wellhead BOP stack assembly using the present invention.

FIG. 3 shows one specific application of, in this case, two removable seals 10 as described with respect to FIGS. 1 and 2. In this example, the seals 10 are located in a spool bore 50 around which a toroidal separator, as described in our co-pending application filed on the same day and entitled "Well Drilling and Completion System", (Agent's Ref: MJB07415EP) is located.

In order for the separator 51 to operate effectively, it is necessary to maintain a fluid tight pressure barrier between the unseparated mud 52 below the upper removable seal 10 and the separated drilling mud 53 above the upper removable seal 10. The lower removable seal 10 is provided as a backup and to ensure that, if the upper removable seal 10 needs to be removed, the appropriate pressure barrier can still be provided.

FIG. 4 shows a series of steps during low or high pressure drilling relative to atmosphere of a well bore 60 in which a BOP ram package 61 is connected to the upper end of a well 62. Above the BOP ram package, a separator 63as described in our co-pending application filed on the same day and entitled Well Drilling Completions System describes, is provided, in connection with a lower riser package 64, leading into a riser 65, including a riser annular 66 or a sealing element 10.

Figure 4D:
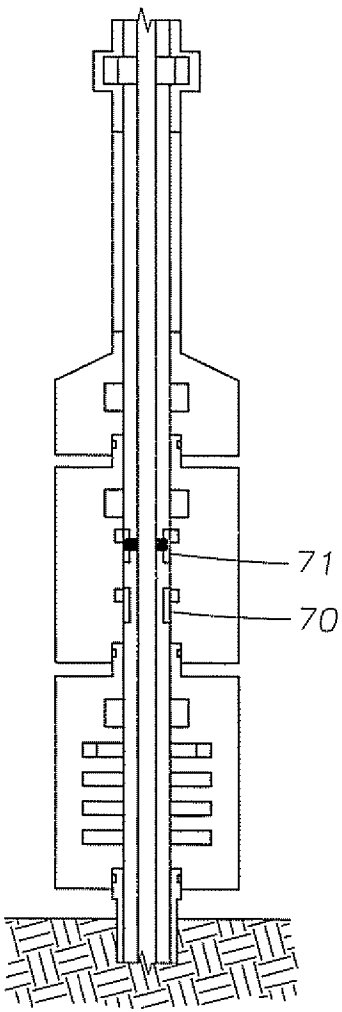
FIGS. 4*a* to 4*d* show various stages for equipment to enter the well with a full riser of fluid when carrying out low pressure drilling.
Figure 4C:
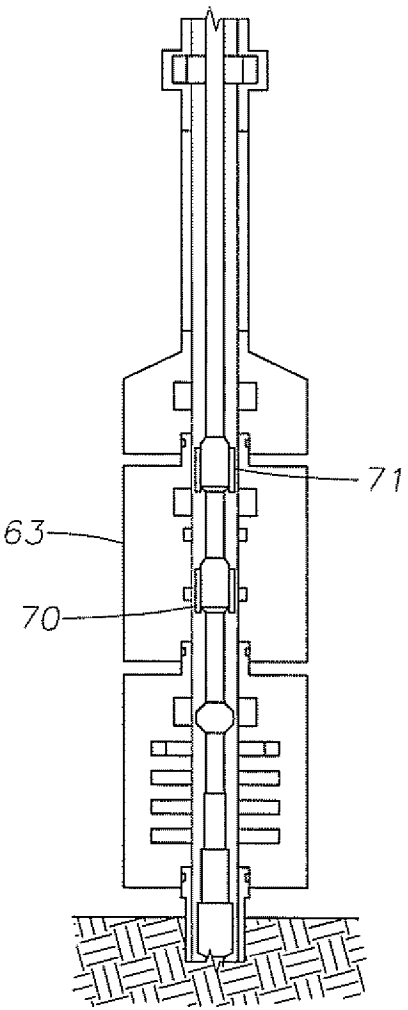
Figure 4B:
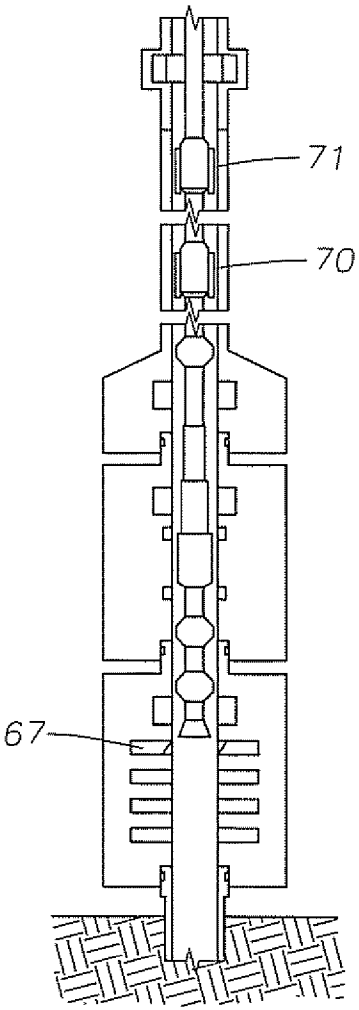
Figure 4A:
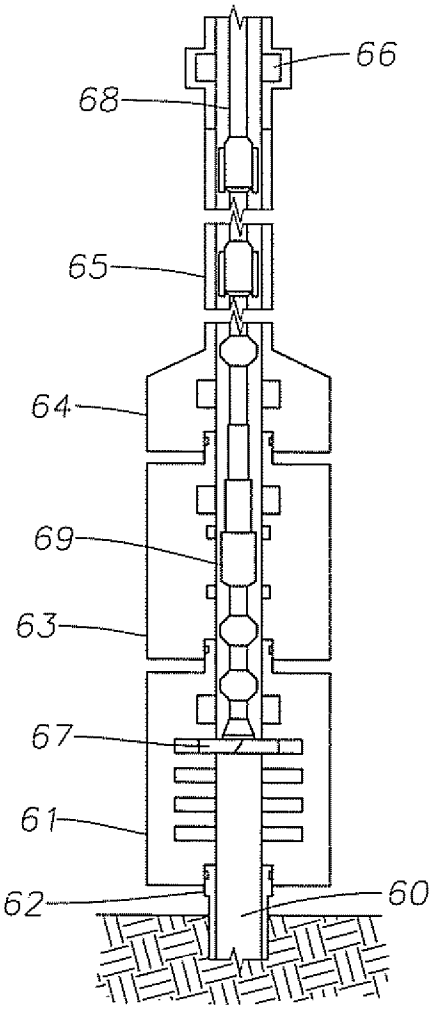

The BOP ram package is provided with a number of rams, including a blind shear ram 67 which, in FIG. 4*a*, is closed until the tubular pipe 68, having a drilling bottom hole assembly 69 which cannot be sealed against due to protrusions and flutes at its lower end, reaches the blind shear ram 67. At this point, the riser annular 66 is closed, and the blind shear ram 67 opened to permit the tubular pipe to be passed through the BOP ram package 61. It is essential that the LRP 64 and the riser section up to the riser annular 66 is suitably rated for either the pressure differential in the well 60 versus the sea water hydrostatic pressure in burst or collapse modes.

The tubular pipe 68 is carrying a lower 70 and an upper 71 removable seal which, as can been seen in FIG. 4*c*, are lowered until they are in the appropriate position within the bore passing through the separator 63, at which point the removable seals can be engaged with that bore, as described with reference to FIG. 1, and, once both removable seals are in place, the upper seal 71 can be energised about the tubular pipe 68, the riser annular 66 can be opened and the tubular pipe 68 can be run to the bottom of the hole to enable drilling to continue. The lower removable seal 70 remains on standby should the upper seal fail, or need to be replaced.

A similar procedure would apply to a surface operation where the sealing elements 10 and the annular 66 would be contained in a spool housing above the BOP ram package 61. The BOP separator 69 could possibly be located adjacent to the BOP ram package 61 as height is at a premium on a surface operation.

The construction of my removable seal will be readily understood from the foregoing description and it will be seen that I have provided a removable seal that can easily be run into the bore of a housing body using drill pipe and should the seal become damaged, it is an easy process to withdraw the removable seal. Furthermore, while the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the appended claims.

What is claimed is:

1. A removable seal for positioning in a bore around an tubular pipe which, in use, passes therethrough, the seal comprising:

a cylindrical outer sleeve having an axial bore, the sleeve having at least one engagement portion for engaging, in use, with an internal surface of the bore; and a sealing element mounted on the cylindrical outer sleeve for, in use, extending into the axial bore to seal around the tubular pipe passing therethrough, wherein the sealing element is rotatably mounted on the outer sleeve.

2. The removable seal according to claim 1, wherein the outer sleeve includes an annular recess in which the sealing element is retained.

3. The removable seal according to claim 2, wherein the sealing element is mounted on a rotatable inner sleeve within the annular recess.

4. The removable seal according to claim 3, wherein the sealing element is rotatably mounted adjacent either end of the outer sleeve.

5. The removable seal according to claim 4, further comprising one or more sealing elements between the rotatable inner sleeve and die outer sleeve to prevent fluid flow therebetween.

6. The removable seal according to claim 5, further comprising one or more biassing elements for urging the sealing element to its retracted position.

7. The removable seal according to claim 6, wherein the biassing means is at least one retracting spring ring retained within the sealing element.

8. A removable seal for positioning in a bore around an tubular pipe which, in use, passes therethrough, the seal comprising:

a cylindrical outer sleeve having an axial bore, the sleeve having at least one engagement portion for engaging, in use, with an internal surface of the bore; and a sealing element mounted on the cylindrical outer sleeve for, in use, extending into the axial bore to seal around the tubular pipe passing therethrough, wherein the outer sleeve includes an annular recess in which the sealing element is retained.

9. The removable seal according to claim 8, wherein the sealing element is mounted on a rotatable inner sleeve within the annular recess.

10. The removable seal according to either claim 9, wherein the sealing element is rotatably mounted adjacent either end of the outer sleeve.

11. A seal according to claim 10, further comprising one or more sealing elements between the rotatable inner sleeve and the outer sleeve to prevent fluid flow therebetween.

12. The removable seal according to any claim 11, further comprising one or more biassing elements for urging the sealing element to its retracted position.

13. The removable seal according to claim 12, wherein the biassing means is at least one retracting spring ring retained within the sealing element.

14. A sealing mechanism for use in a bore, the mechanism comprising:

a body having a bore extending therethrough;

an engagement means for extending from a wall of the body into the bore for engagement with a removable seal according to any one of the preceding claims;

at least one seal for preventing the fluid flow between the removable seal and the inner wall of the body;

actuating means for causing, in use, the sealing element to extend into the axial bore within the outer sleeve of the removable seal; a supply of hydraulic fluid within the body such that the actuating means supplies hydraulic fluid to cause the sealing element to extend into the bore, wherein the at least one seal for preventing fluid flow between the removable seal and the inner wall of the body is retractably mounted within the tubular element.

15. The sealing mechanism according to claim 14, wherein the retractable seal engages with a recess on the outer sleeve of the removable seal.

16. The sealing mechanism according to claim 15, further comprising a retractable orientation pin, mounted within the body for engagement with an orientation profile on the outer sleeve of the removable seal.

17. The sealing mechanism according to claim 16, further comprising hydraulic fluid system for operating the retractable seal and/or the orientation pin.

18. The sealing mechanism according to claim 17, further comprising a second removable seal engaging with the body.

* * * * *